US007540794B2

(12) United States Patent
Inoue et al.

(10) Patent No.: US 7,540,794 B2
(45) Date of Patent: Jun. 2, 2009

(54) SEALING STRUCTURE OF OUTBOARD MOTOR

(75) Inventors: Kazuhiko Inoue, Hiroshima (JP); Yu Ito, Hamamatsu (JP)

(73) Assignees: Nishikawa Rubber Co., Ltd., Hiroshima-shi (JP); Yamaha Hatsudoki Kabuhsiki Kaisha, Iwata-shi (JP)

( * ) Notice: Subject to any disclaimer, the term of this patent is extended or adjusted under 35 U.S.C. 154(b) by 0 days.

(21) Appl. No.: 11/999,701

(22) Filed: Dec. 4, 2007

(65) Prior Publication Data

US 2008/0146098 A1 Jun. 19, 2008

(30) Foreign Application Priority Data

Dec. 15, 2006 (JP) ..... 2006-337827

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS 5,135,239 A * 8/1992 Kato et al. ..... 277/645
7,249,985 B2 * 7/2007 Fukuoka et al. ..... 440/77
7,316,596 B2 * 1/2008 Kameoka ..... 440/77

FOREIGN PATENT DOCUMENTS

JP 2006-213152 A 8/2006

* cited by examiner

*Primary Examiner*—Stephen Avila
(74) *Attorney, Agent, or Firm*—Frishauf, Holtz, Goodman & Chick, P.C.

(57) ABSTRACT

A sealing structure of an outboard motor includes a bottom cowling covering a lower part of an engine, a top cowling covering an upper part of the engine, and a sealing material via which the top cowling is coupled to the bottom cowling. The sealing material includes an installation base member fitted on the bottom cowling. The installation base member has a roughly U-shaped cross-section with an opening into which the top end of the bottom cowling is inserted. A hollow seal member is provided on an outer wall of the installation base member and makes elastic contact with an inner surface of the bottom end of the top cowling. A lip projects outward from the hollow seal member. An upper surface of the lip makes elastic contact with a bottom surface of the bottom end of the top cowling.

8 Claims, 5 Drawing Sheets

SEALING STRUCTURE OF OUTBOARD MOTOR

BACKGROUND OF THE INVENTION

The present invention relates to a sealing structure of an outboard motor in which a top cowling is attached to a bottom cowling through a sealing material in such a manner that a bottom end of the top cowling covering an upper part of an engine is installed on an outer side of a top end of the bottom cowling covering a lower part of the engine.

As shown in FIG. 7, an outboard motor 100 is mounted on a stern plate 200 of a hull and has a propeller 101, which rotates by means of an engine 102 stored in a cowling 10, mounted on a bottom part thereof through a gear mechanism (not shown).

The cowling 10 comprises a bottom cowling 11 covering the lower part of the engine 102 and a top cowling 12 covering the upper part of the engine 102. The top cowling 12 is detachably attached to the bottom cowling 11. As shown in FIG. 8, a bottom end 12*a* of the top cowling 12 is attached on the outer side of a top end 11*a* of the bottom cowling 11 and a sealing material 20 provided between the bottom cowling 11 and the top cowling 12 tightly shuts an aperture between the two cowlings 11 and 12.

The sealing material 20 comprises: a cross-section roughly reversed U-shaped installation base member 21 fitted on the bottom cowling 11 by having the top end 11*a* of the bottom cowling 11 inserted in an opening thereof; a hollow seal member 22 which is fitted on an outer wall of the installation base member 21 and makes an elastic contact with an inner surface of the bottom end 12*a* of the top cowling 12; and a lip 23 projecting outward from an extending end which is a downward-extended part of an outer wall bottom end of the installation base member 21 so as to make an elastic contact with a bottom surface of the bottom end 12*a* of the top cowling 12.

The installation base member 21 has a plurality of projections 24 (FIG. 8 illustrates 4 projections) provided on an inner surface thereof and an insert 25 embedded therein to improve fitting strength of the installation base member 21 to the bottom cowling 11 so that the installation base member 21 does not easily come off the bottom cowling 11.

The above-structured sealing material 20 sufficiently seals a parting portion between the bottom cowling 11 and the top cowling 12 so that water cut-off performance thereof is improved because of the elastic contact made between the bottom end 12*a* of the top cowling 12 and the lip 23 as well as the hollow seal member 22.

In addition, the Japanese unexamined Patent Publication No. 2006-213152 discloses a sealing structure comprising a sealing material which tightly shuts the parting portion between the bottom cowling and the top cowling for the effect of the elastic contact of the hollow seal member, integrally molded with the cross-section roughly reversed U-shaped installation base member fitted on the bottom cowling, with the inside of the top cowling.

Said sealing structure of the Japanese unexamined Patent Publication No. 2006-213152 is characterized in that: the hollow seal member integrally molded with the installation base member fitted on the bottom cowling makes the elastic contact with the inside of the top cowling; and a splash preventive rib part is attached to an inner face of the top cowl, which extends downward around at least a majority of the periphery of the top cowl and positioned inside the top end of the bottom cowl.

Said structure prevents seawater which intrudes into the cowling from splashing in mist inside the cowling even if the hollow seal member does not sufficiently seal the parting portion.

The sealing material 20 shown in FIG. 8, however, may cause deterioration in sealing property when fitting dispersion changes a positional relation of the top cowling 12 toward the bottom cowling 11.

In another word, as shown in FIG. 9(*a*), when the top cowling 12 is attached to an inward position (bottom cowling 11 side) described in a solid line compared with a normal position described in a two-dot chain line, a top end of the lip 23 which makes an elastic contact with a bottom surface of the bottom end 12*a* of the top cowling 12 protrudes outside compared with the top cowling 12 so that sufficient sealing property is not performed and an external appearance deteriorates.

On the other hand, as shown in FIG. 9(*b*), when the top cowling 12 is attached to an outward position (opposite side to the bottom cowling 11) described in a solid line compared with the normal position described in the two-dot chain line, the top end of the lip 23 does not come into contact with the bottom surface of bottom end 12*a* of the top cowling 12 so that the sufficient sealing property is not performed.

In addition, the sealing structure disclosed in the Japanese unexamined Patent Publication No. 2006-213152 proceeds on an assumption that the sufficient sealing property can not obtained and intends to prevent the seawater which intrudes into the cowling from splashing by means of the splash preventive rib part. Therefore, said the sealing structure necessitates the splash preventive rib part as well as the sealing material.

Further, the sealing structure disclosed in the Japanese unexamined Patent Publication No. 2006-213152 does not take the fitting dispersion shown in FIG. 9 into consideration.

Therefore, an object of the present invention is to provide the sealing structure of the outboard motor, which deals effectively with the fitting dispersion and which is excellent in the sealing property as well as the external appearance.

SUMMARY OF THE INVENTION

In order to achieve the above-mentioned object, a first aspect of the invention provides a sealing structure of an outboard motor comprising: a bottom cowling (11) covering a lower part of an engine (102); a top cowling (12) covering an upper part of the engine (102); and a sealing material (30) through which said top cowling (12) is attached to said bottom cowling (11), a bottom end (12*a*) of said top cowling (12) being installed on an outer side of a top end (11*a*) of said bottom cowling (11), wherein said sealing material (30) comprises: a cross-section roughly reversed U-shaped installation base member (31) fitted on the bottom cowling (11) by having the top end (11*a*) of the bottom cowling (11) inserted in an opening thereof a hollow seal member (32) which is fitted on an outer wall of the installation base member (31) and makes an elastic contact with an inner surface of the bottom end (12*a*) of the top cowling (12); and a lip (33) projecting outward from the hollow seal member (32) and of which an upper surface makes an elastic contact with a bottom surface of the bottom end (12*a*) of the top cowling (12).

A second aspect of the invention provides the sealing structure of the outboard motor, wherein the bottom end (12*a*) of the top cowling (12) has an inside corner part thereof diagonally cut out and a cutout (40) thus formed makes an elastic contact with said hollow seal member (32).

A third aspect of the invention provides the sealing structure of the outboard motor, wherein protruding length (50) of said lip (33) is not more than thickness (60) of said bottom end (12*a*) of the top cowling (12).

A fourth aspect of the invention provides the sealing structure of the outboard motor, wherein a bottom end of the outer wall of said installation base member (31) is positioned higher than a bottommost position of said hollow seal member (32) as in the elastic contact with the bottom end (12*a*) of the top cowling (12).

Symbols in parentheses show constituents or items corresponding to Figures and DESCRIPTION OF PREFERRED EMBODIMENT.

According to the sealing structure of the outboard motor as claimed in claim 1 of the present invention, the hollow seal member and the lip projecting outward from the hollow seal member simultaneously make the elastic contact along the bottom surface and the inner surface of the bottom end of the top cowling so that a parting portion between the bottom cowling and the top cowling is sufficiently sealed.

In addition, the structure of the hollow seal member having the lip integrally molded therewith enables a simultaneous bend of the hollow seal member and the lip at the time of the elastic contact. Such a structure deals effectively with the fitting dispersion of the bottom end of the top cowling both in vertical and horizontal directions toward the top end of the bottom cowling and is excellent in the sealing property as well as the external appearance.

Further, the integral molding of the lip with the hollow seal member miniaturizes size of the sealing material, thereby lowering cost required.

According to the sealing structure of the outboard motor as claimed in claim 2 of the present invention, the cutout formed on the inside corner part of the bottom end of the top cowling makes the elastic contact with the hollow seal member. That is, an upper side part of the hollow seal member compared with the base of the lip makes the elastic contact along the cutout at the time of the elastic contact. Therefore, formation of the cutout improves hermetic performance, thereby improving sealing property compared with a sealing structure of an outboard motor without a cutout on the inside corner part of the bottom end of the top cowling.

According to the sealing structure of the outboard motor as claimed in claim 3 of the present invention, the protruding length of the lip is not more than the thickness of the bottom end of the top cowling so as to prevent the lip from protruding outward compared with the top cowling at the time of the elastic contact with the bottom surface of the bottom end of the top cowling and deterioration in the external appearance.

According to the sealing structure of the outboard motor as claimed in claim 4 of the present invention, the bottom end of the outer wall of the installation base member is positioned higher than the bottommost position of the hollow seal member as in the elastic contact with the bottom end of the top cowling. Therefore, the lip which comes into contact with the bottom surface of the bottom end of the top cowling at the time of the elastic contact and the lower side part of the hollow seal member compared with the base of the lip are visible from the outside whereas the outer wall of the installation base member is not visible. Therefore, an excellent external appearance is attained.

DESCRIPTION OF PREFERRED EMBODIMENT

Figure 1:
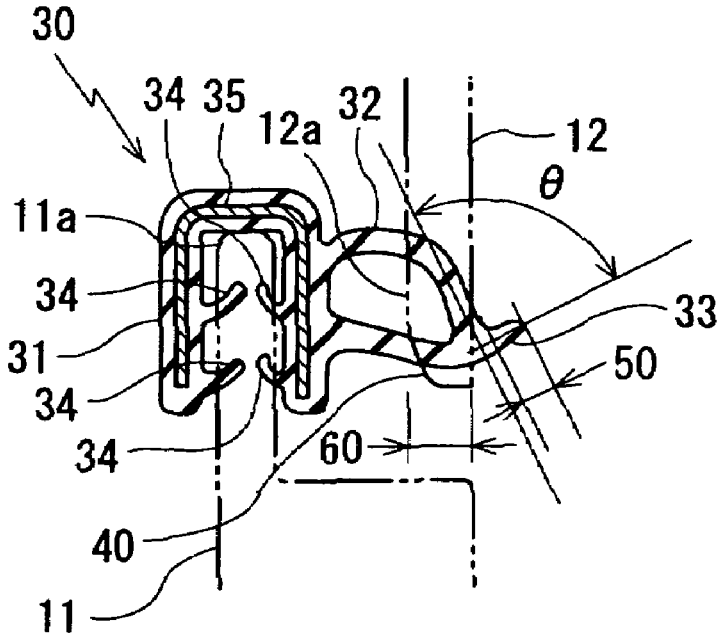
FIG. 1 is a cross section of a sealing material used in a sealing structure of an outboard motor according to an embodiment of the present invention.
Figure 2:
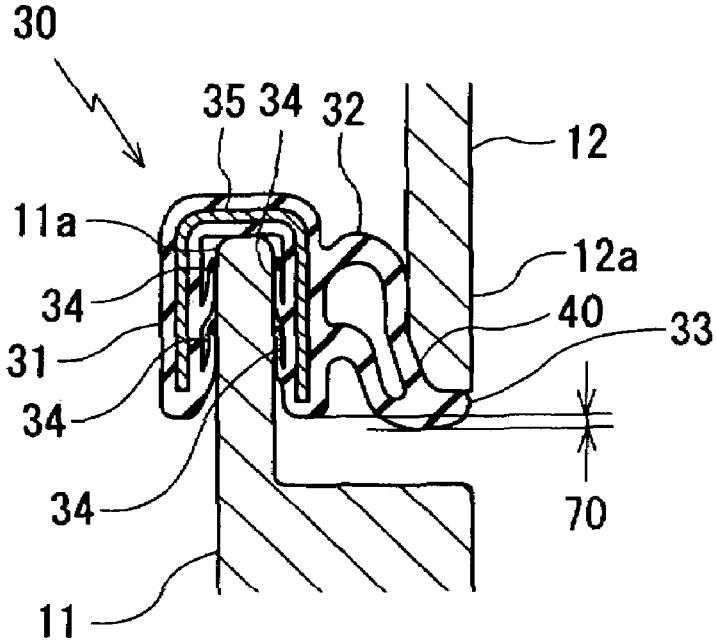
FIG. 2 is a partial enlarged cross section of a sealing state of the sealing material of FIG. 1.
Figure 7:
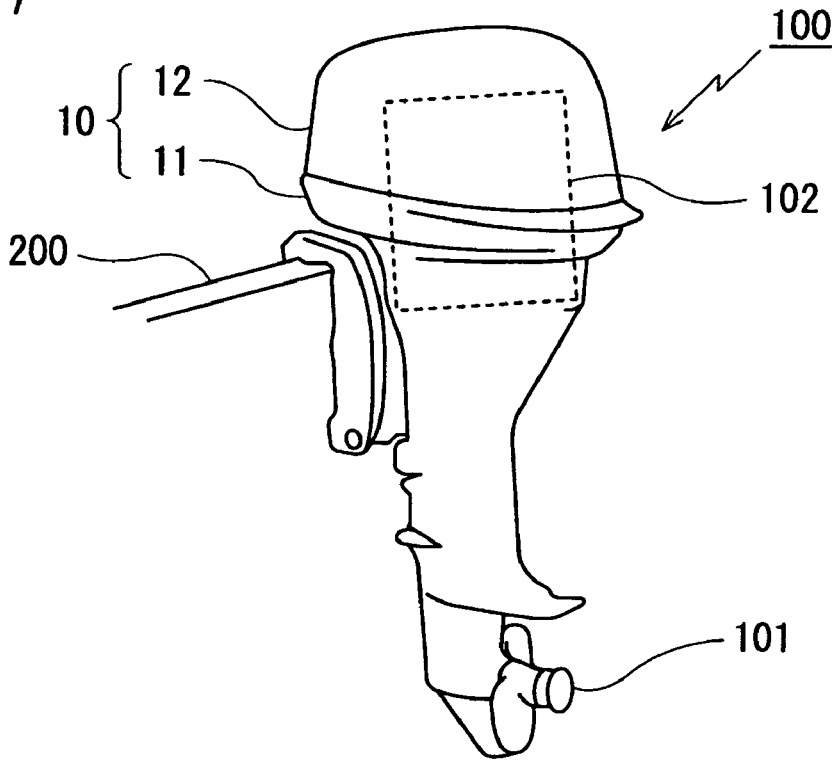
FIG. 7 is an oblique perspective view of an external appearance of an outboard motor.
Figure 8:
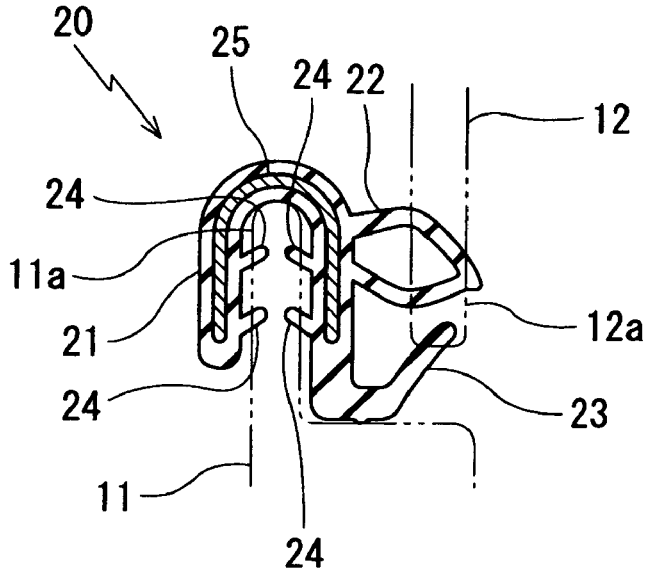
Fig. 8 PRIOR ART
FIG. 8 is a cross section of a sealing material used in a sealing structure of an outboard motor according to a prior art.
Figure 9:
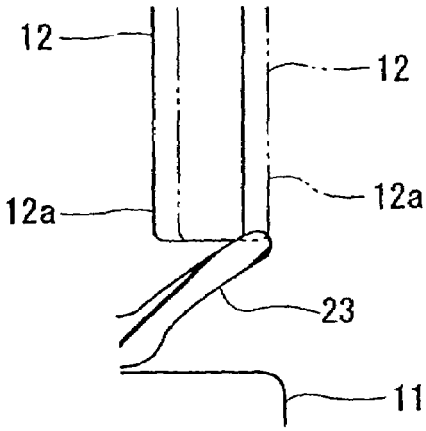
Fig. 9 (a) PRIOR ART
FIG. 9 is a partial enlarged cross section of a sealing state of the sealing material of FIG. 8, facing a fitting dispersion.
Figure 9:
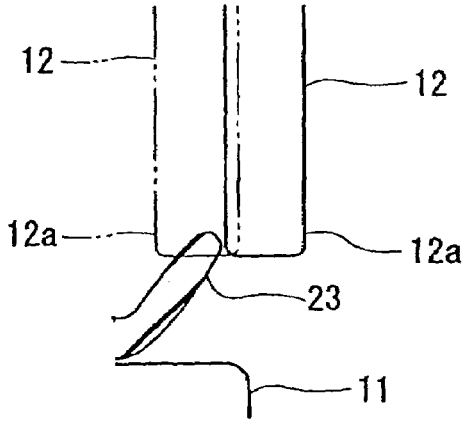
Fig. 9 (b) PRIOR ART

Referring to FIG. 1, FIG. 2 and FIG. 7, a sealing structure of an outboard motor of the present invention will be described. When constituents included in the present invention correspond to those in prior arts, the same symbols are used.

The sealing structure of the outboard motor according to the embodiment of the present invention relates to an outboard motor 100 shown in FIG. 7, which is mounted on a stern plate 200 of a hull and in which, as shown in FIGS. 1 and 2, a top cowling 12 is detachably attached to a bottom cowling 11 through a sealing material 30 in such a manner that a bottom end 12*a* of the top cowling 12 covering an upper part of an engine 102 is installed on an outer side of a top end 11*a* of the bottom cowling 11 covering a lower part of the engine 102. The outboard motor 100 has a propeller 101 mounted on a bottom part thereof through a gear mechanism (not shown), which rotates by means of an engine 102 stored in a cowling 10.

A sealing material 30 used in the sealing structure of the outboard motor according to the embodiment of the present invention comprises: a cross-section roughly reversed U-shaped installation base member 31 fitted on the bottom cowling 11 by having the top end 11*a* of the bottom cowling 11 inserted in an opening thereof, a hollow seal member 32 which is fitted on an outer wall of the installation base member 31 and makes an elastic contact with an inner surface of the bottom end 12*a* of the top cowling 12; and alip 33 projecting outward from the hollow seal member 32 and of which an upper surface makes an elastic contact with a bottom surface of the bottom end 12*a* of the top cowling 12.

The installation base member 31 has a plurality of projections (the present embodiment illustrates 4 projections) provided on an inner surface thereof and an insert 35 embedded therein so as to increase fitting strength of the installation base member 31 to the bottom cowling 11. Sufficient fitting strength of the installation base member 31 to the bottom cowling 11 enables an omission of the insert 35.

The lip 33 projecting diagonally upward from an outermost bottom part of the hollow seal member 32 has a cross-section roughly tongue shape.

As shown in FIG. 1, an angle θ between an extending direction of the lip 33 and a part of the hollow seal member 32 where the hollow seal member 32 comes into contact with the base of the lip 33 from an upper side is about 90 degrees. Said angle θ may be less than 90 degrees in order to increase the elastic contact made along the bottom surface to the inside corner part of the bottom end 12*a* of the top cowling 12.

In addition, protruding length 50 of the lip 33 is not more than thickness 60 of the bottom end 12*a* of the top cowling 12 so as to prevent an outward protrusion of the top end of the lip 33 at the time of the elastic contact and deterioration in the external appearance.

Further, as shown in FIG. 2, the bottom end of the outer wall of the installation base member 31 is positioned higher by 70 than the bottommost position of the hollow seal member as in the elastic contact with the bottom end of the top cowling (the bottom end of the outer wall of the installation base member 31 may also be positioned on the same level as the bottommost position of the hollow seal member as in the elastic contact with the bottom end of the top cowling). According to the structure, the lip 33 which comes into contact with the bottom surface of the bottom end 12*a* of the top cowling 12 at the time of the elastic contact and the lower side part of the hollow seal member 32 compared with the base of the lip are visible from the outside whereas the outer wall of the installation base member 31 is not visible. Therefore, an excellent external appearance is attained.

Furthermore, the bottom end 12*a* of the top cowling 12 originally is of a plate shape but has an inside corner part thereof diagonally cut out so that a cutout 40 thus formed makes an elastic contact with said hollow seal member. According to the structure, an upper side part of the hollow seal member 32 compared with the base of the lip 33 makes the elastic contact along the cutout 40 thus formed at the time of the elastic contact. Therefore, both the hollow seal member 32 and the lip 33 wrappingly seal the bottom end of the top cowling 12, that is from the bottom surface to the cutout 40 of the bottom end 12*a* of the top cowling 12. The top cowling 12 without the cutout 40 on the inside corner part thereof performs sufficient sealing property but the top cowling 12 having the cutout 40 formed on the inside corner part thereof performs an efficiently improved sealing property.

Examples of materials used as the hollow seal member 32 and the lip 33 include rubber materials such as EPDM and resin materials such as TPE and PVC.

According to the sealing structure of the outboard motor, a simultaneous elastic contact of the hollow seal member 32 and the lip 33 projecting outward from the hollow seal member 32, made along the bottom surface and the inner surface of the bottom end 12*a* of the top cowling 12 enables the sufficient sealing of a parting portion between the bottom cowling 11 and the top cowling 12.

In addition, the structure of the hollow seal member 32 having the lip 33 integrally molded therewith enables a simultaneous bend of the hollow seal member 32 and the lip 31 at the time of an elastic contact. Such a structure deals effectively with the fitting dispersion of the bottom end 12*a* of the top cowling 12 toward the top end 11*a* of the bottom cowling 11 as shown in FIGS. 3 to 6 and is excellent in the sealing property as well as the external appearance.

Figure 3:
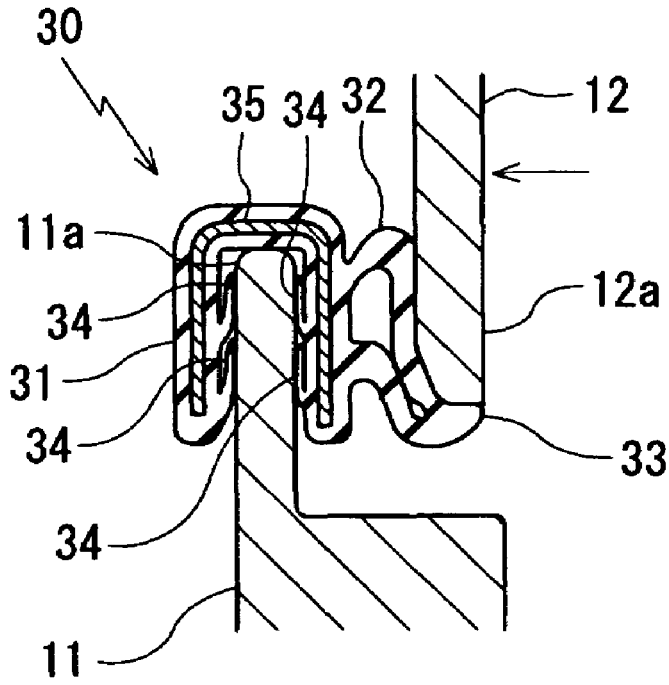
FIG. 3 is a partial enlarged cross section of the sealing state of the sealing material of FIG. 1 where an elastic contact is made at a horizontally close position because of fitting dispersion.
Figure 4:
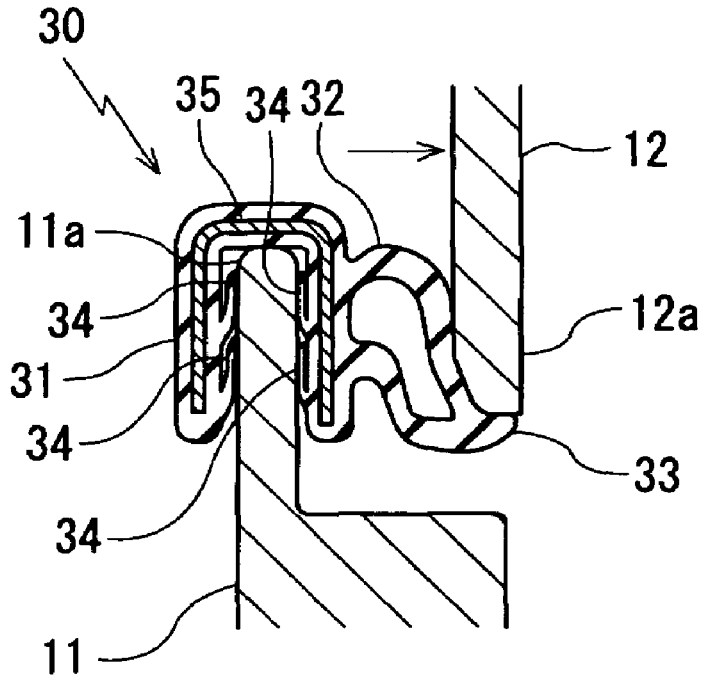
FIG. 4 is a partial enlarged cross section of the sealing state of the sealing material of FIG. 1 where the elastic contact is made at a horizontally distant position because of the fitting dispersion.
Figure 5:
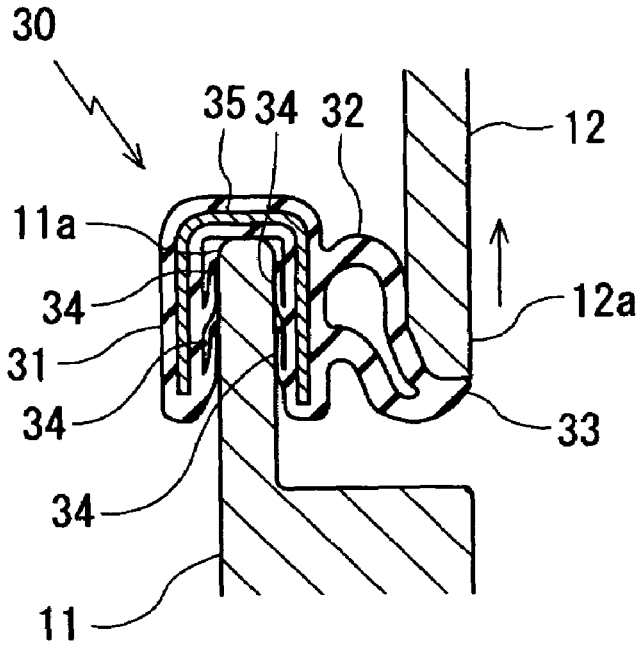
FIG. 5 is a partial enlarged cross section of the sealing state of the sealing material of FIG. 1 where the elastic contact is made at an upward distant position because of the fitting dispersion.
Figure 6:
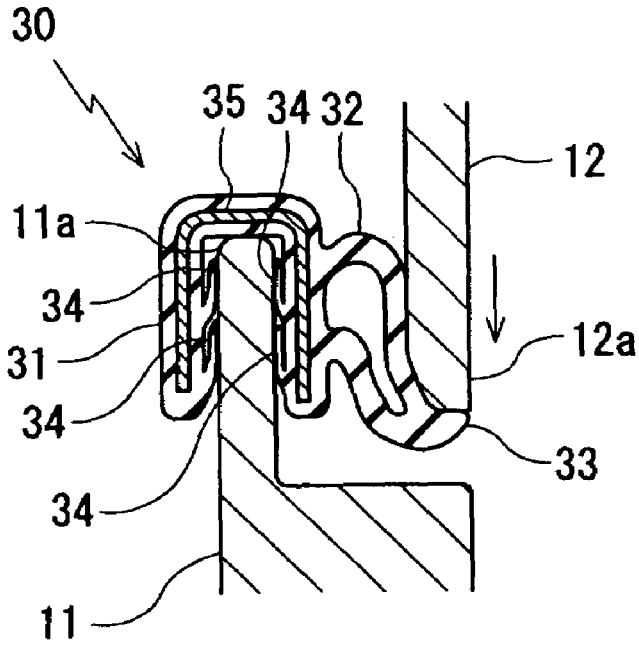
FIG. 6 is a partial enlarged cross section of the sealing state of the sealing material of FIG. 1 where the elastic contact is made at a downward distant position because of the fitting dispersion.

In another word, even in case the fitting dispersion causes the elastic contact to be made at a horizontally close position as shown in FIG. 3 (the left side in FIG. 3), at a horizontally distant position as shown in FIG. 4 (the right side in FIG. 4), at an upward distant position as shown in FIG. 5 (the upper side in FIG. 5) and a downward distant position as shown in FIG. 6 (the lower side in FIG. 6), both the hollow seal member 32 and the lip 31, which have a consecutive elastic contact position toward the bottom end 12*a* of the top cowling 12, simultaneously bend and wrappingly seal the inner side and the lower side of the bottom end 12*a* of the top cowling 12, thereby performing the sufficient sealing property.

Further, an integral molding of the lip with the hollow seal member miniaturizes size of the sealing material, thereby lowering cost required.

The invention claimed is:

1. A sealing structure of an outboard motor comprising:

a bottom cowling covering a lower part of an engine;

a top cowling covering an-upper part of the engine; and a sealing material via which said top cowling is coupled to said bottom cowling, a bottom end of said top cowling being installed on an outer side of a top end of said bottom cowling, wherein said sealing material comprises:

an installation base member fitted on the bottom cowling, the installation base member having a roughly U-shaped cross-section with an opening into which the top end of the bottom cowling is inserted;

a hollow seal member which is provided on an outer wall of said installation base member, and which makes elastic contact with an inner surface of the bottom end of the top cowling; and a lip projecting outward from said hollow seal member, the lip having a roughly tongue-shaped cross-section, wherein the lip includes an upper surface that makes elastic contact with a bottom surface of the bottom end of said top cowling, and a bottom surface that does not contact said bottom cowling when the upper surface makes the elastic contact with the bottom surface of the bottom end of said top cowling.

2. The sealing structure of the outboard motor as claimed in claim 1, wherein the bottom end of the top cowling has comprises a cutout at which an inside corner part of the bottom end of the top cowling is diagonally cut out, and the cutout makes elastic contact with said hollow seal member.

3. The sealing structure of the outboard motor as claimed in claim 1, wherein a protruding length of said lip is not more than a thickness of the bottom end of said top cowling.

4. The sealing structure of the outboard motor as claimed in claim 1, wherein a bottom end of the outer wall of said installation base member is positioned higher than a bottommost position of said hollow seal member in the elastic contact with the bottom end of the top cowling.

5. The sealing structure of the outboard motor as claimed in claim 2, wherein a protruding length of said lip is not more than a thickness of the bottom end of said top cowling.

6. The sealing structure of the outboard motor as claimed in claim 5, wherein a bottom end of the outer wall of said installation base member is positioned higher than a bottommost position of said hollow seal member in the elastic contact with the bottom end of the top cowling.

7. The sealing structure of the outboard motor as claimed in claim 2, wherein a bottom end of the outer wall of said installation base member is positioned higher than a bottommost position of said hollow seal member in the elastic contact with the bottom end of the top cowling.

8. The sealing structure of the outboard motor as claimed in claim 3, wherein a bottom end of the outer wall of said installation base member is positioned higher than a bottommost position of said hollow seal member in the elastic contact with the bottom end of the top cowling.

* * * * *